US010709228B2

(12) United States Patent
McLaughlin

(10) Patent No.: US 10,709,228 B2
(45) Date of Patent: Jul. 14, 2020

(54) GOLF BALL HOLDER DEVICE

(71) Applicant: Meaghan McLaughlin, Sarasota, FL (US)

(72) Inventor: Meaghan McLaughlin, Sarasota, FL (US)

( * ) Notice: Subject to any disclaimer, the term of this patent is extended or adjusted under 35 U.S.C. 154(b) by 113 days.

(21) Appl. No.: 15/273,211

(22) Filed: Sep. 22, 2016

(65) Prior Publication Data

US 2017/0106252 A1 Apr. 20, 2017

Related U.S. Application Data

(60) Provisional application No. 62/222,199, filed on Sep. 22, 2015, provisional application No. 62/239,088, filed on Oct. 8, 2015.

(51) Int. Cl.

| | |
|---|---|
| ***A45F 5/00*** | (2006.01) |
| ***A45F 5/02*** | (2006.01) |
| ***A63B 47/00*** | (2006.01) |
| ***A63B 57/20*** | (2015.01) |

(52) U.S. Cl.
CPC ..... *A45F 5/021* (2013.01); *A63B 47/001* (2013.01); *A63B 57/20* (2015.10)

(58) Field of Classification Search
CPC ..... A45F 5/021; A63B 57/20; A63B 47/001
USPC ..... 224/242
See application file for complete search history.

(56) References Cited

U.S. PATENT DOCUMENTS

| | | | | | |
|---|---|---|---|---|---|
| 1,814,887 | A * | 7/1931 | Bender | A41F 9/002 | 224/682 |
| 2,548,330 | A * | 4/1951 | Wiseman | A63B 47/001 | 224/245 |
| 4,062,482 | A * | 12/1977 | Szalony | A63B 47/001 | 224/247 |
| 4,068,785 | A * | 1/1978 | Goudreau | A63B 47/001 | 224/247 |
| 4,106,678 | A * | 8/1978 | Thomas | A63B 47/001 | 224/269 |
| 4,396,136 | A * | 8/1983 | Stafford, Jr. | A63B 47/001 | 224/245 |
| 4,850,483 | A * | 7/1989 | Stack | A63B 55/20 | 206/315.9 |
| 5,004,137 | A * | 4/1991 | Wu | A63B 57/00 | 224/274 |
| 6,029,850 | A * | 2/2000 | Pate | A63B 47/00 | 221/64 |
| 6,168,061 | B1 * | 1/2001 | Harrison | A63B 47/001 | 224/666 |
| 6,193,120 | B1 * | 2/2001 | Chang | A63B 47/001 | 224/245 |
| 6,234,307 | B1 * | 5/2001 | Beck | A63B 47/00 | 206/315.9 |
| 6,439,424 | B1 * | 8/2002 | Threadgill, Jr. | A63B 47/002 | 221/185 |

(Continued)

*Primary Examiner* — Peter N Helvey
(74) *Attorney, Agent, or Firm* — Edward M. Livingston, Esq.; Livingston Law, P.A.

(57) ABSTRACT

A golf ball holder device has a concave body made of a yieldably bendable material. The concave body is arcuate in shape both length-wise and width-wise so as to define an interior surface forming an interior cavity and an opening to the interior cavity through which a golf ball can be inserted into or removed from a snug gripping hold by the interior surface on the golf ball within the interior cavity of the concave body.

16 Claims, 10 Drawing Sheets

(56) References Cited

U.S. PATENT DOCUMENTS

| | | | | |
|---|---|---|---|---|
| D711,644 | S * | 8/2014 | Leach | D3/257 |
| 2001/0050241 | A1* | 12/2001 | Pratt | A63B 55/20 206/315.9 |
| 2003/0019895 | A1* | 1/2003 | Childers | A45F 5/02 224/251 |
| 2004/0178095 | A1* | 9/2004 | Mora | A45F 5/021 206/315.9 |
| 2005/0255940 | A1* | 11/2005 | Tebbe | A63B 45/02 473/351 |
| 2006/0124562 | A1* | 6/2006 | Simonetta Kurcheski | A63B 47/00 211/14 |
| 2007/0257074 | A1* | 11/2007 | Harrison | A63B 47/001 224/269 |
| 2007/0267454 | A1* | 11/2007 | Baiz | A45C 5/06 224/576 |
| 2009/0026348 | A1* | 1/2009 | Sopel | A01K 15/025 248/686 |
| 2009/0032419 | A1* | 2/2009 | Kealy | A63B 47/00 206/315.9 |
| 2009/0277940 | A1* | 11/2009 | Cook | A63B 45/02 224/576 |
| 2012/0024915 | A1* | 2/2012 | Young | A63B 47/002 224/196 |
| 2015/0352409 | A1* | 12/2015 | Darr | A63B 47/00 206/315.9 |
| 2016/0052462 | A1* | 2/2016 | Heilgendorf | B60R 7/08 224/274 |

* cited by examiner

GOLF BALL HOLDER DEVICE

This application claims the benefit of U.S. Provisional Application No. 62/222,199, filed Sep. 22, 2015, and U.S. Provisional Application No. 62/239,088, filed Oct. 8, 2015, which are hereby incorporated by reference in their entireties.

BACKGROUND OF THE INVENTION

The present invention relates to a golf ball holder device.

When playing a round of golf, the need may arise to replace or exchange one golf ball for another for various reasons. One reason might be to replace a ball that landed in a water hazard. Another reason might be to exchange a more heavily used or scarred golf ball for a relatively new one on holes where the chance of losing the golf ball is greater due to hazards or locations where the golf ball may go out of bounds. Still another reason might be to substitute a golf ball that the player only uses on greens.

Many golfers carry extra golf balls in their pants, jacket pockets or golf bags for these reasons. Bulges in clothing caused by the presence of one or more golf balls in pockets are not only uncomfortable to the wearer, likely to interfere with use of pockets for other items, and potentially damaging to the clothing, but more importantly may also interfere with players' swings.

Many different designs of golf ball holders have been proposed that may be mounted on or attached to belts or waist bands of players so as to maintain one or more golf balls in a convenient, accessible position that does not interfere with players' swings and also eliminates the need to repeatedly use clothing pockets. However, the sheer number of different designs proposed in the prior art lends credence to the belief that none have come close to an optimum design.

SUMMARY OF THE INVENTION

The present invention is directed to a golf ball holder device. In embodiments, the holder device of the present invention has a profile that closely follows a portion of the spherical contour of a golf ball so as to snugly hold the golf ball, and with the addition of a suitable attachment, such as a clip or chain, may secure the golf ball to a belt, waist band, belt loop or externally to a pocket in a manner that is comfortable to and minimizes interference with the movements of its wearers.

According to an aspect of the present invention, the golf ball holder device includes a concave body made of a yieldably bendable material. This material may be for example polycarbonate. The concave body is arcuate in shape both length-wise and width-wise so as to define an interior surface forming an interior cavity and an opening to the interior cavity. A golf ball can be inserted into or removed from the interior cavity via the opening. The interior surface exerts a snug gripping hold on the golf ball when inserted within the interior cavity of the concave body.

In another aspect of the present invention, the golf ball holder also includes a plurality of nubs formed on the concave body, the nubs being provided spaced apart from each other in two rows, one of the rows being along one of a pair of opposite ends of the interior surface of the body and the other of the rows being along the other of the pair of opposite ends of the interior surface of the body, the nubs in the rows protruding from the interior surface into the opening of the interior cavity wherein the one row of nubs project toward the other row of nubs.

In another aspect of the present invention, the golf ball holder device also includes a pair of wings made of the same yieldably bendable material, each wing being arcuate in shape both length-wise and width-wise and integrally formed at central locations on opposite sides of a central portion of the concave body and extending forward a short distance so as to thereby add to or augment the snug hold by the interior surface of the concave body on the golf ball along the opposite sides thereof.

In another aspect of the present invention, the golf ball holder device also includes a pair of flanges made of the same yieldably bendable material, each flange being arcuate in shape at least width-wise of the flange and integrally formed on opposite ends of the concave body so as to protrude outwardly therefrom in opposite directions with respect to one another, such that the flanges are graspable by fingers of a user to yieldably flex opposite body portions of the concave body about a central transverse axis extending across the central portion of the concave body so as to move the opposite ends of the concave body away from one another and thereby temporarily increase the size of the interior cavity and its opening to facilitate the ease of insertion and removal of the golf ball into and from the snug gripping hold of the golf ball by the concave body.

In another aspect of the present invention, the golf ball holder device also includes an attachment configured in the form of either a clip or a chain adapted to be secured to the concave body for carrying the holder device externally on the person of the user.

These and other aspects and advantages of the present invention will become apparent to those skilled in the art upon a reading of the following detailed description when taken in conjunction with the drawings wherein there is shown and described an illustrative embodiment of the present invention.

DESCRIPTION OF THE DRAWINGS

In the following detailed description, reference will be made to the attached drawings in which.

REFERENCE NUMERALS/PARTS LIST

Figure 5:
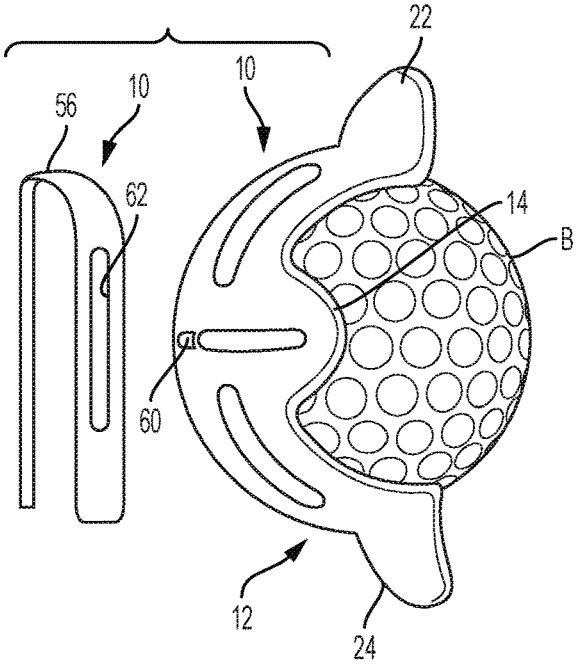
FIG. 5 is a side elevational view of the golf ball holder device with an exemplary embodiment of one clip that may be secured to the holder device at its rear.
Figure 6:
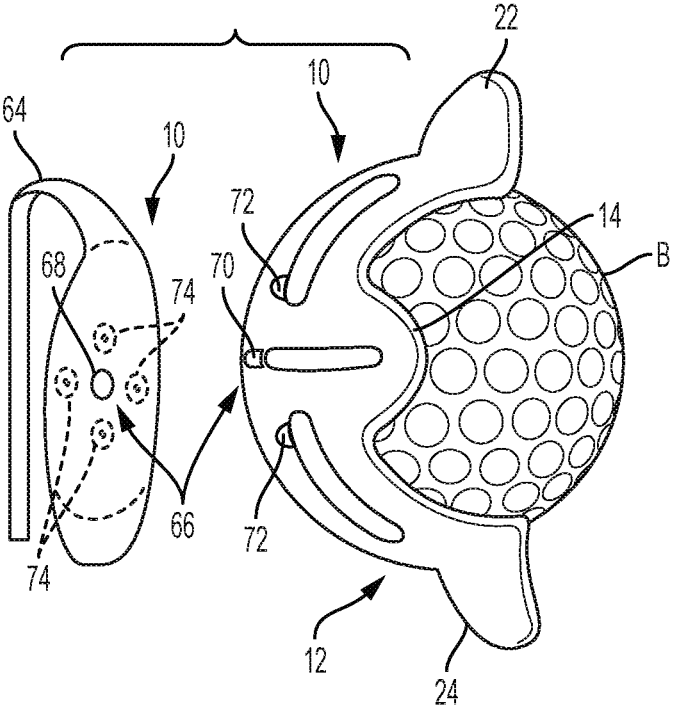
FIG. 6 is another side elevational view of the golf ball holder with an exemplary embodiment of another clip that may be secured to the holder device at its rear.

10—golf ball holder device
12—concave body of device 10
14—one wing of device 10
16—other wing of device 10
18—one side of body 12
20—other side of body 12
22—one flange of device 10
24—other flange of device 10
26—one end of body 12
28—other end of body 12
30—interior surface of body 12
32—interior cavity of body 12
B—golf ball
34—opening to interior cavity 32
36—nubs in one row on one end 26 of body 12
38—nubs in other row on other end 28 of body 12
40—central portion of body 12
A—central transverse axis
42—front surface of one flange 22
44—front surface of other flange 24
46—back exterior surface of body 12
48—one opposite body portion of body 12
50—other opposite body portion of body 12
52—longitudinal slots in body 12
54—transverse slots in body 12
56—clip (FIG. 5)
58—chain
60—protuberance or nub on back of body 12 (FIG. 5)
62—slot in clip 56 (FIG. 5)
64—clip (FIG. 6)
66—mechanical pivot (FIG. 6)
68—socket in clip 64 (FIG. 6)
70—protruding axle on concave body 12 (FIG. 6)
72—dimples on concave body 12 (FIG. 6)
74—depressions in clip 64 (FIG. 6)

DETAILED DESCRIPTION OF THE INVENTION

Referring to FIGS. 1-6 of the drawings, there is illustrated an exemplary embodiment of a golf ball holder device, generally designated 10, in accordance with various aspects of the present invention. The holder device 10 includes a concave body 12, a pair of wings 14, 16 located respectively on opposite sides 18, 20 of the concave body 12, and a pair of flanges 22, 24 located respectively on opposite ends 26, 28 of the concave body 12. The concave body 12, wings 14, 16 and flanges 22, 24 may be made of the same yieldably bendable material.

The concave body 12 of the holder device 10 is arcuate in shape both length-wise and width-wise of the concave body 12 so as to define an interior surface 30 forming an interior cavity 32 and an opening 34 to the interior cavity 32 through which a golf ball B may be partially received or placed into the interior cavity 32 and may be removed therefrom. When the golf ball B is seated or nested on the interior surface 30 in the interior cavity 32 of the concave body 12, a snug gripping hold within the interior cavity 32 by contact with the interior surface 30 of the concave body 12 on the golf ball B results from the interior surface 30 of the concave body 12, length-wise between the opposite ends 18, 20 thereof, extending more than 180 degrees and less than 190 degrees about the circumference of the golf ball B and, width-wise between the opposite sides 26, 28, extending more than 60 degrees and less than 90 degrees about the circumference of the golf ball B.

To enhance the ability of the holder device 10 to securely retain the golf ball B in the snug gripping hold of the concave body 12, the holder device 10 also has a plurality of nubs 36, 38 formed thereon. Advantageously, the nubs 36, 38 are provided spaced apart from each other in two rows, one row being along the one end 26 of the interior surface 30 of the body 12 and the other row being along the other end 28 of the interior surface 30 of the body 12. The nubs 36, 38 in the rows thereof protrude a short distance from the interior surface 30 into the opening 34 to the interior cavity 32 wherein the one row of nubs 36 project toward the other row of nubs 38. Although two pairs of nubs (or four nubs) are shown in each row, the invention is not so limited in view that nubs in other numbers may be employed.

To further enhance the ability of the holder device 10 to securely retain the golf ball B in the snug gripping hold of the concave body 12, the wings 14, 16 of the holder device 10 are provided on the opposite sides 18, 20 of the concave body 12. The wings 14, 16 are arcuate in shape both length-wise and width-wise and integrally formed at central locations on the opposite sides 18, 20 of a central portion 40 of the concave body 12 and provide short side extensions of the interior surface 30 of the concave body 12. The wings 14, 16 extend length-wise and width-wise more than 5 degrees and less than 15 degrees about the circumference of the golf ball B. In such manner, the wings 14, 16 thereby add to or augment the gripping hold on the golf ball B by the interior surface 30 of the concave body 12 along the opposite sides 18, 20 thereof.

To facilitate flexing of the concave body 12 about a central transverse axis A, passing through the central portion 40 of the concave body 12, in order to facilitate the ease of insertion or release of the golf ball B into or from the interior cavity 32 of the concave body 12, the flanges 22, 24 are provided on the opposite ends 26, 28 of the concave body 12. Each of the flanges 22, 24 is arcuate in shape at least width-wise and integrally formed on opposite ends 26, 28 of the concave body 12 so as to protrude in opposite directions with respect to one another outwardly therefrom.

By a user holding the holder device 10 in the palm of one hand and grasping the end flanges 22, 24 on their front surfaces 42, 44, the user may simultaneously push forward on a back exterior surface 46 of the concave body 12 and pull backward on the flanges 22, 24, thereby causing opposite body portions 48, 50 of the concave body 12 to yieldably flex about the central transverse axis A so as to temporarily increase the size of the interior cavity 32 and the opening 34 to the interior cavity 32. This will facilitate the ease of insertion or release of the golf ball B into or from the snug gripping hold by the interior surface 30 of the concave body 12 and the rows of nubs 36, 38 on the opposite ends 26, 28 of the concave body 12. The insertion and release of the golf ball B is facilitated also by the user using the fingers of the other hand to grip opposite sides of the golf ball B and then push the golf ball into or pull the golf ball from the interior cavity 32 of the concave holder 12.

From the foregoing description and drawings, it can be easily recognized and understood that the two opposite body portions 48, 50 of the concave body 12 extending in opposite directions from the central portion 40 and the central transverse axis A are substantially mirror images of one another and may be characterized as forming a pair of concave arms in a half-moon configuration extending in opposite directions and being biased to assume the relative rest position, as shown in FIGS. 1-5, in which they face more or less toward one another to provide the snug gripping hold on the golf ball B. The concave arms may be yieldably flexed about the transverse axis A away from one another to facilitate the ease of insertion or release of the golf ball B into or from the gripping hold of the arms. Also, the concave body 12 has a plurality of longitudinal and transverse slots 52, 54 formed therethrough that may be provided to facilitate bending or flexing at the central portion 40 of the concave body 12.

Figure 1:
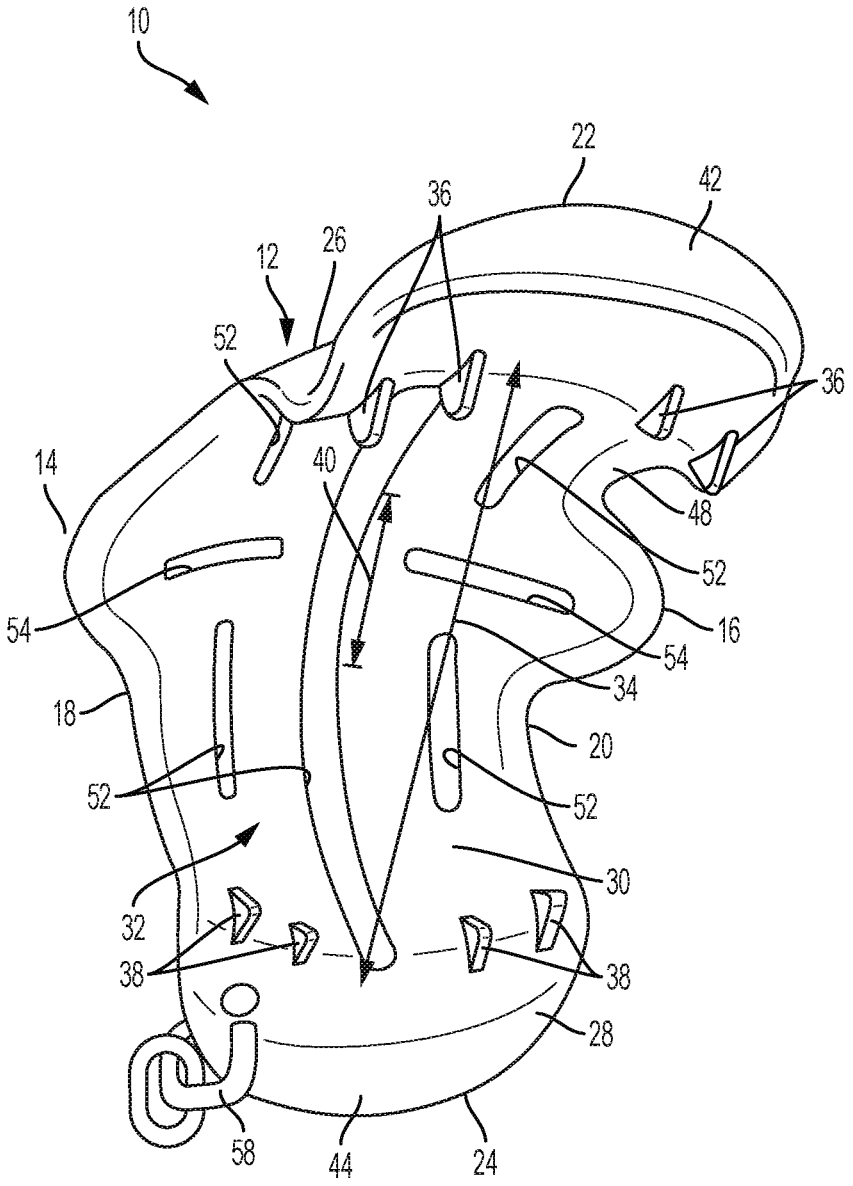
FIG. 1 is a front perspective view of an exemplary embodiment of a golf ball holder device in accordance with aspects of the present invention.
Figure 2:
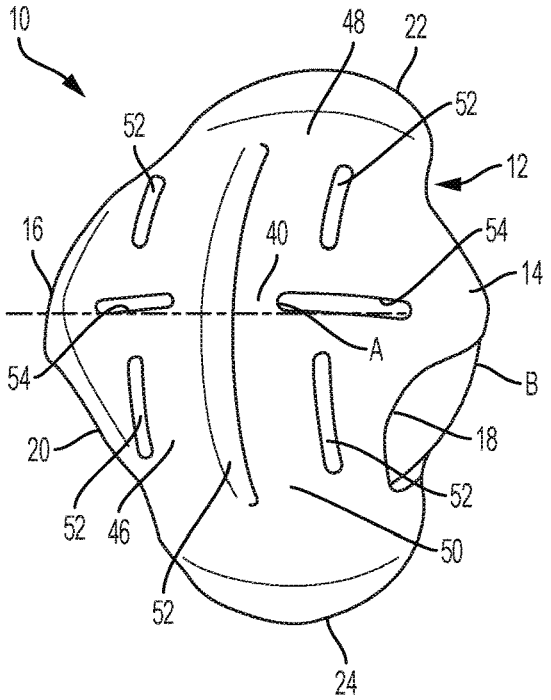
FIG. 2 is a rear perspective view of the golf ball holder device.
Figure 3:
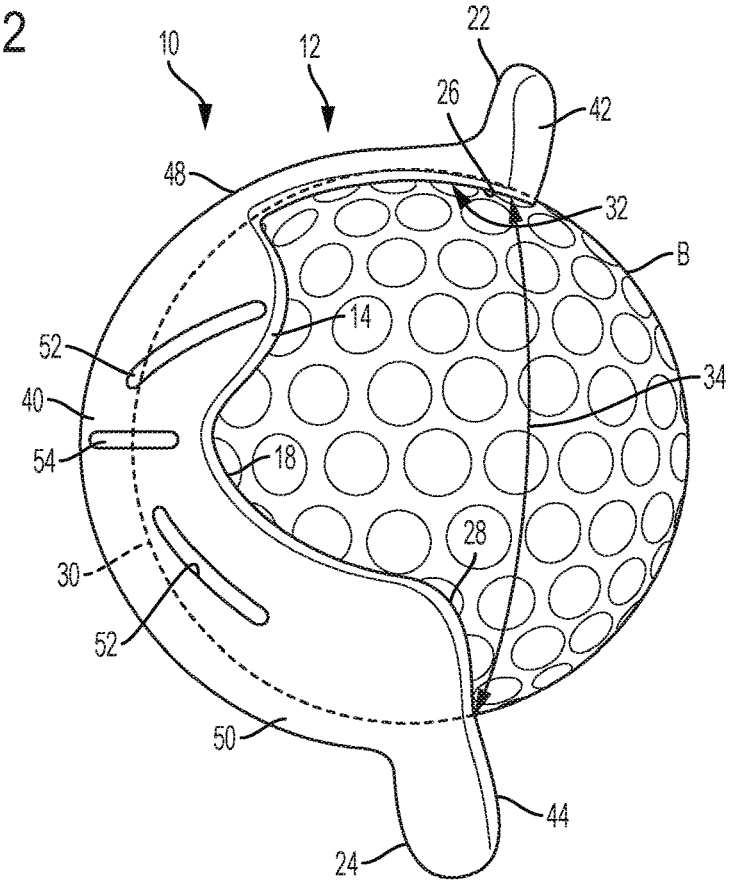
FIG. 3 is a side perspective view of the golf ball holder device.
Figure 4:
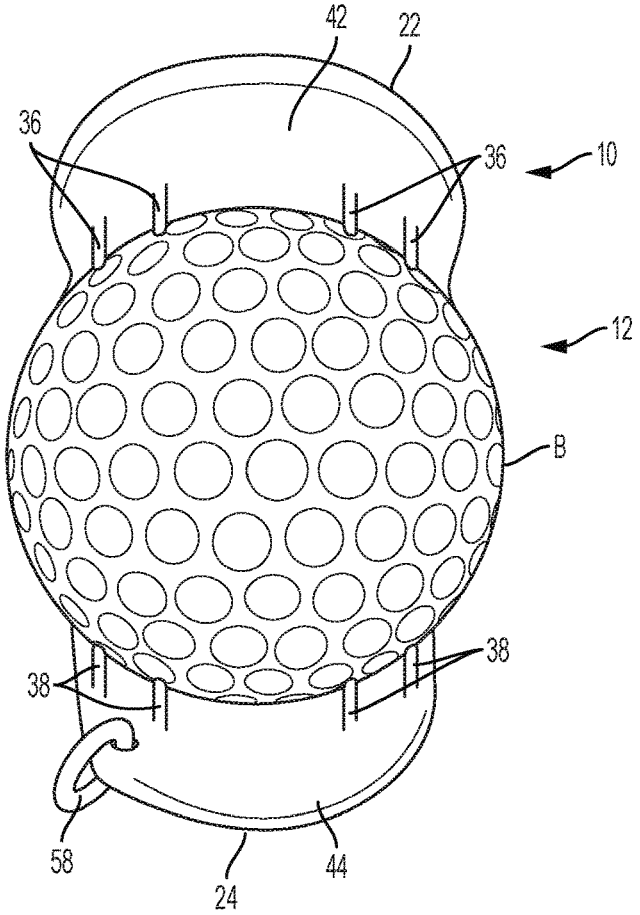
FIG. 4 is a front elevational view of the golf ball holder device.

The holder device 10 may also include an attachment configured in the form of either a clip 56, as shown in FIG. 5, or a chain 58, as partially seen in FIGS. 1 and 4, being secured to concave body 12 for carrying the holder device 10 externally on the person of the user. At the back of the concave body 12 a protuberance or nub 60 may be provided that couples to and slides in a slot 62 in the clip 56. Alternatively, a rotating connection may be provided between the concave body 12 and the clip 56 to enhance usability wherein the concave body 12 may rotated about the nub 60 relative to the clip 56. Also, the clip 56 and concave body 12 of the holder device 10 may be separable or unitary, and in various embodiments multiple concave bodies may be attached to a single clip for holding multiple golf balls, or multiple clips may be attached to form a multiple-ball holder device.

The holder device 10 may also include an alternative attachment configured in the form of a clip 64, as shown in FIG. 6, being secured to concave body 12 by a mechanical pivot 66. The mechanical pivot 66 comprises a socket 68 formed in the clip 64 and a protruding axle 70 formed at the back of the concave body 12 and rotatably secured in the socket 68. Also, two curved dimples 72 are formed at and protruding from the back of the concave body 12 spaced from the protruding axle 70 at twelve and six o'clock positions relative thereto. The clip 64 has four curved depressions 74 formed therein at twelve, three, six and nine o'clock positions and shaped to mateably receive the dimples 72. Given such arrangement and configurations of dimples 72 and depressions 74, the concave body 12 may be turned relative to the clip 64 and seated at either vertical or horizontal orientations relative to the clip 64. In other words, the flanges 22, 24 may in some embodiments be aligned vertically along the same axis as the clip 64 as shown, with wings 14, 16 aligned horizontally, and in other embodiments the flanges 22, 24 may be aligned horizontally and the wings vertically (as in FIGS. 7-8 and 10). Although these are generally the most convenient arrangements, in fact any angle (along all axis) may be chosen, with flanges aligned for example somewhere between horizontal and vertical (with the vertical axis defined by the clip) and even tilted forwards or backwards or side-to-side with respect to the clip. This is true regardless of the form of the clip and the way in which the clip 64 and body 12 are secured—for example even when the clip and body are formed as an integral unit as illustrated in FIGS. 7-12.

Figure 7:
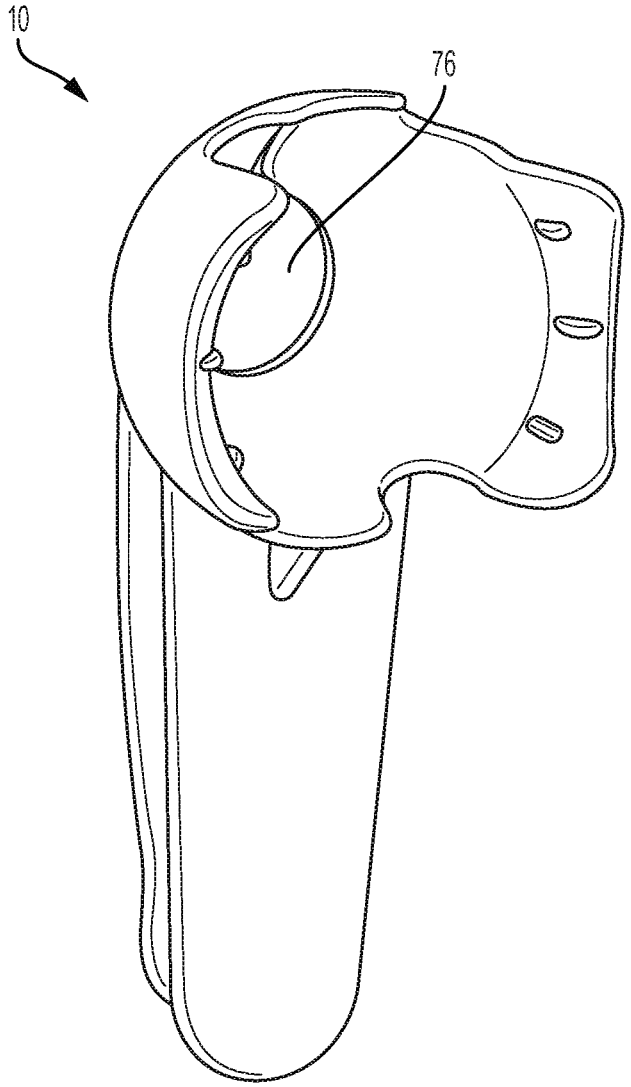
FIG. 7 is a front view perspective of another embodiment of a golf ball holder device in accordance with aspects of the present invention having a circular rear hole.

FIG. 7 shows another embodiment of a golf ball holder device 10 having a circular rear hole 76. This hole may enhance the ease of removing a ball from the holder, by pressing on the back of the ball with a finger or other object.

Figure 8:
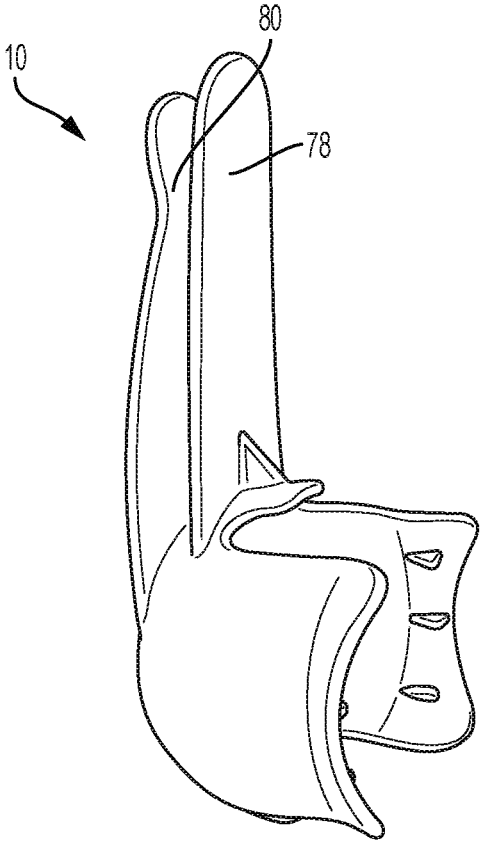
FIG. 8 is a side view perspective of another embodiment of a golf ball holder device in accordance with aspects of the present invention having an integral clip.

FIG. 8 is a side view perspective of another embodiment of a golf ball holder device 10 having an integral clip 78. This clip may be various lengths to accommodate clipping to various articles of clothing etc. The bottom of the clip may have a cinch 80 to help keep the clip tight and secure to a belt or other article, for example by narrowing the clip below the height of a typical belt to a width less than that of a typical belt.

Figure 9:
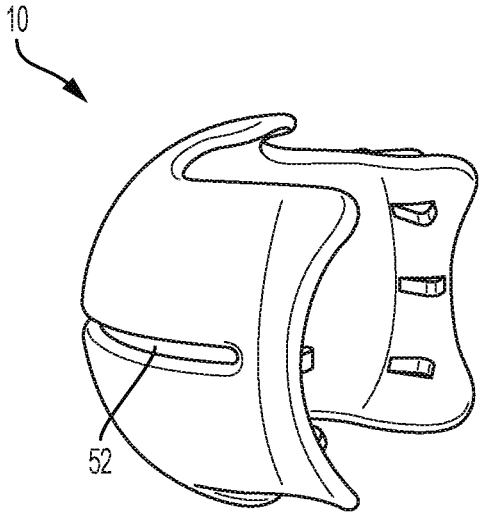
FIGS. 9-12 are perspective views of another embodiment of a golf ball holder device in accordance with aspects of the present invention.
Figure 10:
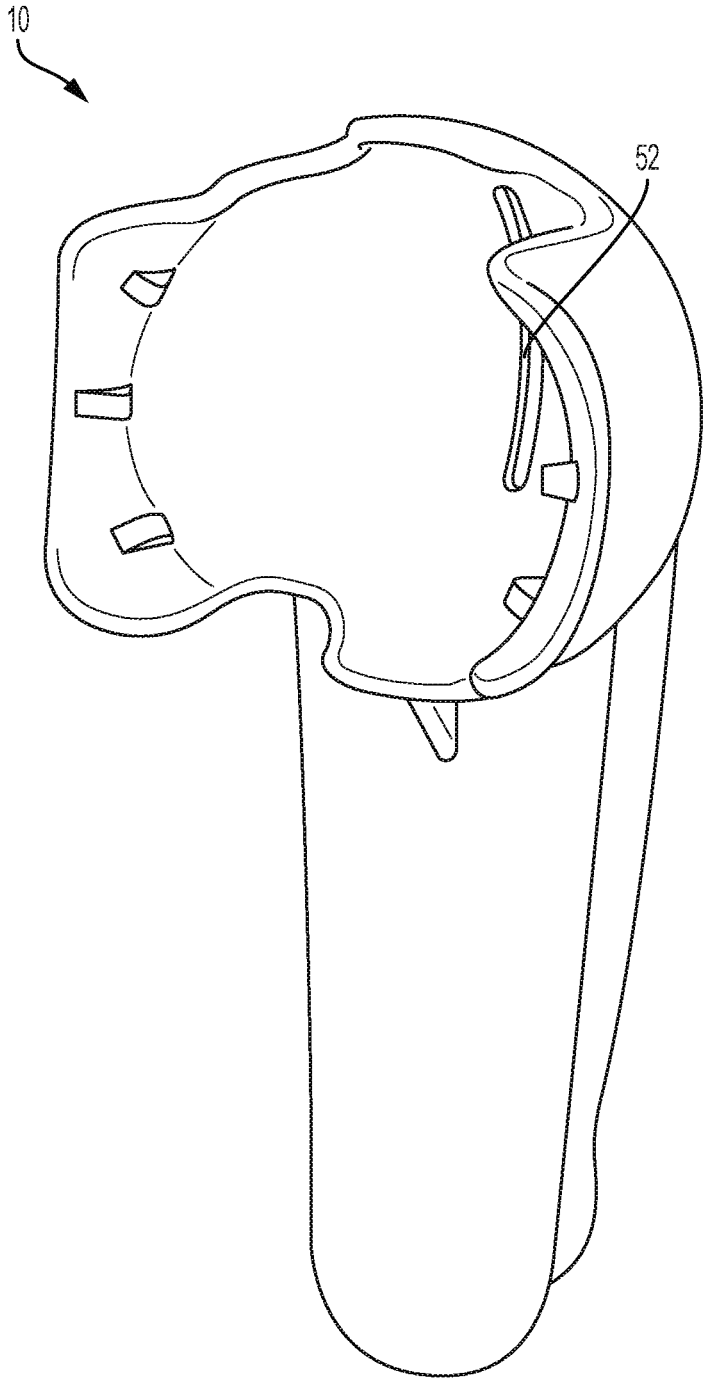
Figure 11:
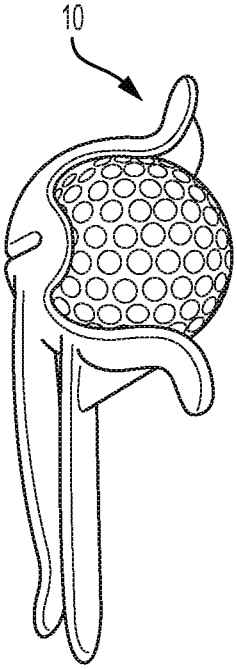
Figure 12:
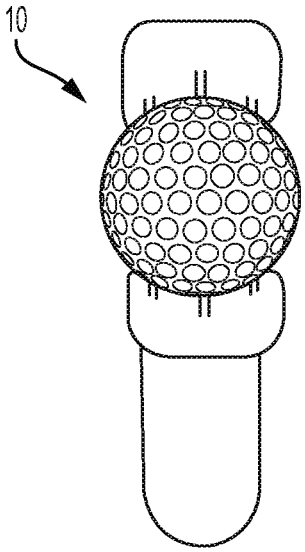

FIGS. 9-10 are perspective views of another embodiment of a golf ball holder device in accordance with aspects of the present invention. In this embodiment, holder 10 has central a longitudinal slot 52 but no other slots 52, 54. This slot allows water to drain from a wet ball and/or can be used for ball marking.

The holder device 10 may be made of various well-known commercially-available materials, such as conventional flexible plastics. The above-described parts of the holder device 10 may be fabricated using well-known molding techniques. The length and width of the concave body 12, by way of example but not of limitation, may be 3 inches and ¾ inch, respectively. The holder device may be manufactured in one or more of a variety of different colors and with various logos and other graphics and designs.

In various embodiments, the holder device 10 may be duplicated and the individual holder devices joined together to form a multiple-ball holder device. For example, two holder devices 10 may be placed side-by-side adjacent to one another and be joined where they touch on one side to form a two-ball holder device. More holder devices 10 may be added side-by-side or above/below other holder devices to increase the ball-holding capacity. In such embodiments, there may be a single clip for the entire multiple-ball holder, which may be located towards the center of the individual ball holders 10, for example extending downwards from between two central ball holder devices 10. The individual ball holder devices 10 may be joined by any known method, including plastic welding, rivet/fastener, etc., or may be formed integrally using any known plastic forming technique such as molding.

It is thought that the present invention and its advantages will be understood from the foregoing description and it will be apparent that various changes may be made thereto without departing from the spirit and scope of the invention or sacrificing all of its material advantages, the form hereinbefore described being merely an exemplary, and not a restrictive, embodiment thereof.

What is claimed is:

1. A golf ball holder device, comprising:

a concave body made of a yieldably bendable material, said concave body being arcuate in shape both length-wise and width-wise of said body so as to define an interior surface forming an interior cavity and an opening to said interior cavity through which a golf ball can be inserted into or removed from a snug gripping hold by said interior surface on the golf ball within said interior cavity of said concave body, the holder device further comprising:

a pair of wings made of the same yieldably bendable material, each said wing being arcuate in shape both length-wise and width-wise of said wing, said wings being integrally formed at central locations on opposite sides of a central portion of said concave body and providing short side extensions of said interior surface of said concave body so as to thereby add to or augment the snug gripping hold on the golf ball by said interior surface of said concave body along said opposite sides thereof; and a pair of flanges made of the same yieldably bendable material, each said flange being arcuate in shape at least width-wise, said flanges being integrally formed on opposite ends of said concave body so as to protrude outwardly in opposite directions with respect to one another such that said flanges are graspable by fingers of a user to yieldably flex opposite body portions of said concave body about a central transverse axis extending across said central portion of said concave body so as to move the opposite ends thereof away from each other and thereby temporarily increase the size of said interior cavity and said opening of interior cavity to facilitate the ease of the insertion and removal of the golf ball into and from the snug gripping hold by said concave body.

2. The holder device of claim 1, further comprising:

a plurality of nubs formed on said concave body, said nubs being provided spaced apart from each other in two rows, one of said rows being along one of a pair of opposite ends of said interior surface of said body and the other of said rows being along the other of said pair of opposite ends of said interior surface of said body, said rows of nubs protruding from said interior surface into said opening of said interior cavity wherein said one row of nubs project toward said other row of nubs.

3. A golf ball holder device, comprising:

a concave body made of a yieldably bendable material, said concave body being arcuate in shape both length-wise and width-wise of said body so as to define an interior surface forming an interior cavity and an opening to said interior cavity through which a golf ball can be inserted into or removed from a snug gripping hold by said interior surface on the golf ball within said interior cavity of said concave body, the holder device further comprising:

a pair of flanges made of the same yieldably bendable material, each said flange being arcuate in shape at least width-wise, said flanges being integrally formed on opposite ends of said concave body so as to protrude outwardly in opposite directions with respect to one another such that said flanges are graspable by fingers of a user to yieldably flex opposite body portions of said concave body about a central transverse axis extending across said central portion of said concave body so as to move the opposite ends thereof away from each other and thereby temporarily increase the size of said interior cavity and said opening of interior cavity to facilitate the ease of the insertion and removal of the golf ball into and from the snug gripping hold by said concave body, wherein each of the pair of flanges extends outwardly from said central transverse axis, thereby enlarging said opening to said interior cavity.

4. The holder device of claim 1, further comprising:

an attachment configured in the form of one of a clip and a chain being secured to said concave body for carrying the holder device externally on the person of the user.

5. The holder device of claim 3, further comprising:

a plurality of nubs formed on said concave body, said nubs being provided spaced apart from each other in two rows, one of said rows being along one of a pair of opposite ends of said interior surface of said body and the other of said rows being along the other of said pair of opposite ends of said interior surface of said body, said rows of nubs protruding from said interior surface into said opening of said interior cavity wherein said one row of nubs project toward said other row of nubs.

6. The holder device of claim 3, further comprising:

an attachment configured in the form of one of a clip and a chain being secured to said concave body for carrying the holder device externally on the person of the user.

7. The holder device of claim 2, wherein the holder device extends more than 180 degrees and less than 190 degrees length-wise about the golf ball circumference while the golf ball is disposed in the concave body, and wherein the holder device extends more than 60 degrees and less than 90 degrees width-wise about the golf ball circumference while the golf ball is disposed in the concave body.

8. The holder device of claim 3, wherein the holder device extends more than 180 degrees and less than 190 degrees length-wise about the golf ball circumference while the golf ball is disposed in the concave body, and wherein the holder device extends more than 60 degrees and less than 90 degrees width-wise about the golf ball circumference while the golf ball is disposed in the concave body.

9. The holder device of claim 1, wherein each of the pair of wings extends length-wise and width-wise more than 5 degrees and less than 15 degrees about the golf ball circumference while the golf ball is disposed in the concave body.

10. The holder device of claim 1, wherein the concave body further comprises one or more longitudinal slots disposed on an exterior surface of the concave body that is opposite to the interior surface of the concave body.

11. The holder device of claim 3, wherein the concave body further comprises one or more longitudinal slots disposed on an exterior surface of the concave body that is opposite to the interior surface of the concave body.

12. A golf ball holder device, comprising:

a concave body made of a yieldably bendable material, said concave body being arcuate in shape both length-wise and width-wise of said body so as to define an interior surface forming an interior cavity and an opening to said interior cavity through which a golf ball can be inserted into or removed from a snug gripping hold by said interior surface on the golf ball within said interior cavity of said concave body; and a plurality of nubs formed on said interior surface of said concave body, each of said plurality of nubs protruding into said interior cavity, wherein at least one of said plurality of nubs is disposed on each of a pair of opposite ends of said interior surface, and wherein the plurality of nubs assists in providing the snug gripping hold by said interior surface on the golf ball within said interior cavity of said concave body, wherein one or more of the plurality of nubs has a variable cross-section between an exterior end closet to an outer edge of the interior surface and interior end farthest from the outer edge of the interior surface, said variable cross-section being thickest at a point between the exterior end and the interior end and tapering to zero thickness at said exterior and interior ends.

13. The holder device of claim 12, further comprising:

an attachment configured in the form of one of a clip and a chain being secured to said concave body for carrying the holder device externally on the person of the user.

14. The holder device of claim 12, wherein the concave body further comprises one or more longitudinal slots disposed on an exterior surface of the concave body that is opposite to the interior surface of the concave body.

15. The holder device of claim 2, wherein the nubs are positioned such that they obstruct the golf ball within said interior cavity from falling out of said interior cavity, and wherein force exerted on the golf ball in the direction of said opening results in an increased force on the golf ball from the nubs.

16. The holder device of claim 5, wherein the nubs are positioned such that they obstruct the golf ball within said interior cavity from falling out of said interior cavity, and wherein force exerted on the golf ball in the direction of said opening results in an increased force on the golf ball from the nubs.

* * * * *